US005344678A

United States Patent [19]

Kajiwara et al.

[11] Patent Number: 5,344,678

[45] Date of Patent: Sep. 6, 1994

[54] SHAFT SLEEVE MADE OF CERAMICS

[75] Inventors: Ken-ichi Kajiwara; Kikuichi Mori, both of Tokyo, Japan

[73] Assignee: Ebara Corporation, Tokyo, Japan

[21] Appl. No.: 811,071

[22] Filed: Dec. 20, 1991

[30] Foreign Application Priority Data

Dec. 25, 1990 [JP] Japan ..... 2-405851

[51] Int. Cl.[5] ..... B32B 18/00

[52] U.S. Cl. ..... 428/34.4; 428/34.6; 428/34.7; 428/36.8; 428/36.91; 428/492; 428/688; 428/689; 428/698; 138/140; 138/141; 415/120

[58] Field of Search ..... 428/34.4, 34.6, 34.7, 428/36.8, 36.91, 492, 688, 689, 698; 138/140, 141, 149, 177; 384/280, 281, 282, 297; 415/120, 124.2, 126, 127, 128

[56] References Cited

U.S. PATENT DOCUMENTS

| | | | |
|---|---|---|---|
| 3,389,579 | 6/1968 | Werner | 138/141 |
| 3,552,815 | 1/1971 | Keller | 384/281 |
| 4,728,582 | 3/1988 | Comans | 428/34.4 |
| 5,125,179 | 6/1992 | Campbell | 428/34.4 |

FOREIGN PATENT DOCUMENTS

| | | |
|---|---|---|
| 0204235 | 6/1987 | European Pat. Off. . |
| 1525200 | 11/1969 | Fed. Rep. of Germany . |
| 8910720 | 1/1990 | Fed. Rep. of Germany . |
| 60-114296 | 8/1985 | Japan . |
| 60-114297 | 8/1985 | Japan . |
| 61-112820 | 5/1986 | Japan . |
| 62-49692 | 3/1987 | Japan . |
| 62-124316 | 6/1987 | Japan . |
| 62-124316 | 6/1987 | Japan . |
| 489523 | 7/1938 | United Kingdom . |

*Primary Examiner*—Ellis P. Robinson
*Assistant Examiner*—Timothy M. Speer
*Attorney, Agent, or Firm*—Wenderoth, Lind & Ponack

[57] ABSTRACT

A shaft sleeve is made of ceramics and provided in confrontation with a stationary sliding member in a sliding bearing or plain bearing. The shaft sleeve made of ceramics comprises a cylindrical body made of ceramics and having a circular outer surface and a circular inner surface, and an elastic member molded on the inner surface of the cylindrical body and being formed with an inner opening having a shape corresponding to the cross section of a shaft. The shaft sleeve is usable under high temperature conditions and with liquids containing much slurry such as, for example, as a shaft sleeve of a pump.

12 Claims, 5 Drawing Sheets

SHAFT SLEEVE MADE OF CERAMICS

BACKGROUND OF THE INVENTION

The present invention relates to a shaft sleeve made of ceramics, and more particularly to a shaft sleeve made of ceramics which is provided in confrontation with a stationary sliding member in a sliding bearing or a plain bearing and preferably used for a submerged bearing in a pump for handling liquid containing hard solid material.

Conventionally, a shaft sleeve made of ceramics is applicable to various usages because of its excellent wear resistance.

FIGS. 5(*a*) and 5(*b*) are a cross-sectional view and a side view, respectively, showing a conventional shaft sleeve. In FIGS. 5(*a*) and 5(*b*), a shaft sleeve 1 is of a cylindrical shape having an inside diameter and an outside diameter formed concentrically. A shaft (not shown) is fitted with the inside diameter of the shaft sleeve 1. Groove-like notches 2 are formed in a right end of the shaft sleeve 1.

FIGS. 6(*a*) and 6(*b*) are a front view and a cross-sectional view, respectively, showing an engaging member 3 for preventing the shaft sleeve 1 from rotating relative to the shaft. The engaging member 3 is formed, on the inside surface thereof, with a key way 4 with which a key (not shown) attached to the shaft is fitted, so that the engaging member 3 is fixed to the shaft and rotated integrally with the shaft. The engaging member 3 is formed, on the left end thereof, with projections 5 which are fitted with the notches 2 of the shaft sleeve 1, whereby the shaft sleeve 1 of FIGS. 5(*a*) and 5(*b*) is prevented from rotating relative to the engaging member 3 and is rotated integrally with the shaft.

FIGS. 7(*a*), 7(*b*) and 7(*c*) are a front view, a side view and an upper plan view, respectively, showing another type of engaging member 13 which is used in conjunction with the shaft sleeve 1 (see FIGS. 5(*a*) and 5(*b*)) fitted with a spline shaft. In FIGS. 7(*a*), 7(*b*) and 7(*c*), the engaging member 13 is formed of sheet metal such as a steel plate and has at the inside surface thereof projections 14 which are fitted with a spline groove of the shaft (not shown). Further, the engaging member 13 is provided at the left end with projections 15 which are fitted with the notches 2 of the shaft sleeve 1, thereby preventing the shaft sleeve 1 from rotating relative to the shaft.

As mentioned above, the shaft sleeve 1 is prevented from rotating relative to the shaft and is rotated together with the shaft by the use of the engaging member 3 (see FIGS. 6(*a*) and 6(*b*)) or the engaging member 13 (see FIGS. 7(*a*)–7(*c*)). That is, in order to prevent the shaft sleeve from rotating relative to the shaft, the engaging member which comprises a different member from the shaft sleeve is required, and the end of the shaft sleeve must be machined to form a groove to engage with the engaging member. However, in the case where the shaft sleeve 1 is made of ceramics, ceramics are brittle and weak in tensile stress, although they are hard. Further, when the shaft sleeve made of ceramics is in operation, stress concentration occurs at the groove-shaped notches 2, and the shaft sleeve can be easily damaged or broken. Further in the case of the spline shaft, as shown in FIG. 8, the shaft sleeve 21 is in contact with the spline shaft 22 at the contacting portions 23 corresponding to the projecting portions of the spline shaft 22. Therefore, the central portions 24 between the adjacent contacting portions 23 are subjected to bending stress. As a result, the shaft sleeve may be damaged or broken.

On the other hand, conventionally, there is a widely used pump which handles liquid having a temperature of 0° to 120° C. In this case, between the shaft sleeve and the shaft, a clearance of about 2/1000 with respect to the outside diameter of the shaft is required due to the difference in thermal expansion coefficients between the shaft sleeve made of ceramics and the shaft made of metal such as stainless steel. For example, if the shaft has an outside diameter of 30 mm, a clearance of 6/100 mm is required. In this case, taking into consideration dimension tolerance besides the above clearance, the clearance of approximately 0.1 mm is required, thus enlarging or enhancing the looseness between the two members at low temperatures.

Further, when the spline shaft or polygonal shaft or the like is employed, the contacting area of the shaft and the shaft sleeve is small, thereby allowing the shaft sleeve to be easily cracked.

SUMMARY OF THE INVENTION

The shaft sleeve made of ceramics has excellent wear resistance, but is weak in tensile strength, can be easily cracked and has a different thermal expansion coefficient from metal which is used in a general shaft. Therefore, the shaft sleeve made of ceramics has only a limited usage.

It is therefore an object of the present invention to provide a shaft sleeve made of ceramics which is usable under high temperature conditions and is usable as a shaft sleeve for a pump for liquids containing much slurry, and for which it is unnecessary to utilize thermal spraying processes or fitting processes that would otherwise be necessary to produce it.

In order to achieve the above object, in accordance with the present invention, there is provided a shaft sleeve made of ceramics and provided on a shaft, comprising: a cylindrical body made of ceramics and having a circular outer surface and a circular inner surface; and an elastic member molded on the inner surface of the cylindrical body, the elastic member being formed with an inner opening having a shape corresponding to the cross section of the shaft.

According to the present invention, when the shaft sleeve is incorporated in a bearing, the variation of the dimension between the bearing and the housing or between the shaft sleeve and the shaft due to temperature changes is absorbed by the elastic member which is molded on the inner surface of the shaft sleeve and has an inner opening having a shape corresponding to the cross section of the shaft.

Further, the elastic member serves as a material for absorbing shocks from external forces.

Furthermore, the elastic member serves as a driving force transmitting member, which causes the driving force is uniformly distributed over the entire inner surface of the ceramic body, thus reducing the chances that the ceramic body will be damaged or broken.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE INVENTION

A shaft sleeve according to an embodiment of the present invention will be described below with reference to FIGS. 1 and 2.

Figure 1:
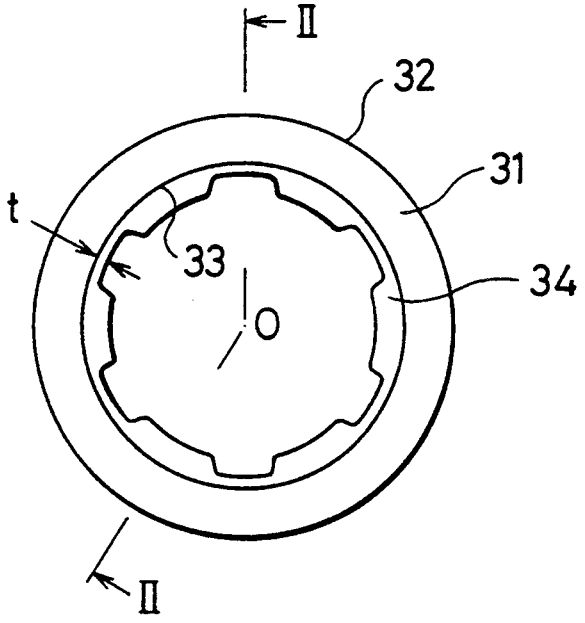
FIG. 1 is an end view showing a shaft sleeve made of ceramics according to an embodiment of the present invention.
Figure 2:
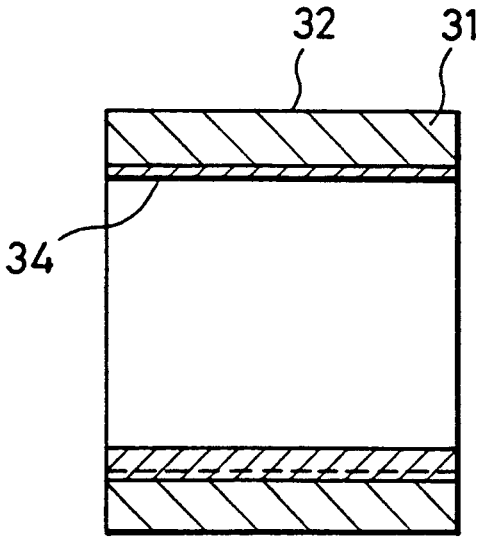
FIG. 2 is a cross-sectional view taken along a line II—II of FIG. 1.

As shown in FIGS. 1 and 2, a shaft sleeve 31 has a cylindrical shape and is provided, on the inside surface thereof, with an elastic member 34. The elastic member 34 is molded on the inner surface of the shaft sleeve 31 and has an inner opening having a shape corresponding to the cross section of the spline shaft (not shown). The shaft sleeve 31 has a circular outer surface 32 serving as a sliding surface and a circular inner surface 33 for carrying the elastic member 34. The sliding surface (the outer cylindrical surface 32) of the shaft sleeve 31 is finished by grinding or polishing so as to have a sufficient accuracy, but the inner cylindrical surface 33 is not finished and remains in a sintered condition.

Further, the elastic member 34 molded on the inner surface of the shaft sleeve 31 comprises elastic material such as rubber and has an inner opening having a shape corresponding to the cross section of the shaft, the shaft being inserted into the shaft sleeve. That is, the shaft sleeve 31 is tightly fitted with the shaft without clearance between the shaft and the elastic member 34. The elastic member 34 preferably has a minimum thickness t in the range of 1 to 10% of the inner diameter of the shaft sleeve 31 so that dimensional variations caused by thermal expansion coefficient difference between the shaft sleeve 31 and the shaft may be absorbed.

With the above structure, when the shaft sleeve 31 is incorporated in the bearing, the dimensional variations between the bearing and the housing, or between the shaft sleeve and shaft due to temperature changes is absorbed by the elastic member 34 molded on the inner surface of the shaft sleeves 31. Further, the elastic member 34 serves as a material for absorbing shocks from external forces applied to the bearing.

Figure 3A:
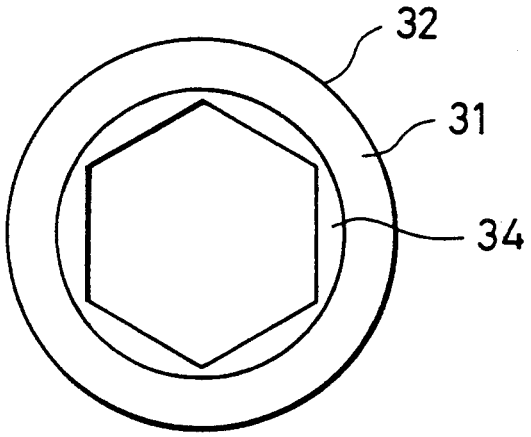
FIGS. 3(*a*) and 3(*b*) are end view showing a shaft sleeve made of ceramics according to further embodiments of the present invention.
Figure 3B:
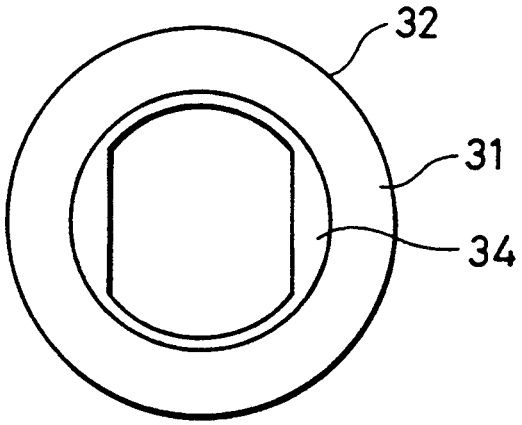

In the embodiment as shown FIGS. 1 and 2, the shaft sleeve 34 which is used in conjunction with the spline shaft is described. FIGS. 3(*a*) and 3(*b*) are end view showing a shaft sleeve having an inner opening having different shapes according to further embodiments of the present invention. FIG. 3(*a*) shows a sleeve shaft 31 made of ceramics which is applied to a shaft having a polygonal cross section. Specifically, the shape of the inner opening of the elastic member 34 is a hexagon which is the same shape as the cross section of the shaft with which the sleeve shaft 31 is used. Further, FIG. 3(*b*) shows a sleeve shaft 31 which is applied to a shaft having two chamfering surfaces. That is, the elastic member 34 has an inner opening having a substantially oblong shape corresponding to the cross section of the shaft having two confronting round surfaces and two confronting straight surfaces.

The shaft sleeves shown in FIGS. 3(*a*) and 3(*b*) have the same functions and effects as the shaft sleeve in FIGS. 1 and 2.

Figure 4:
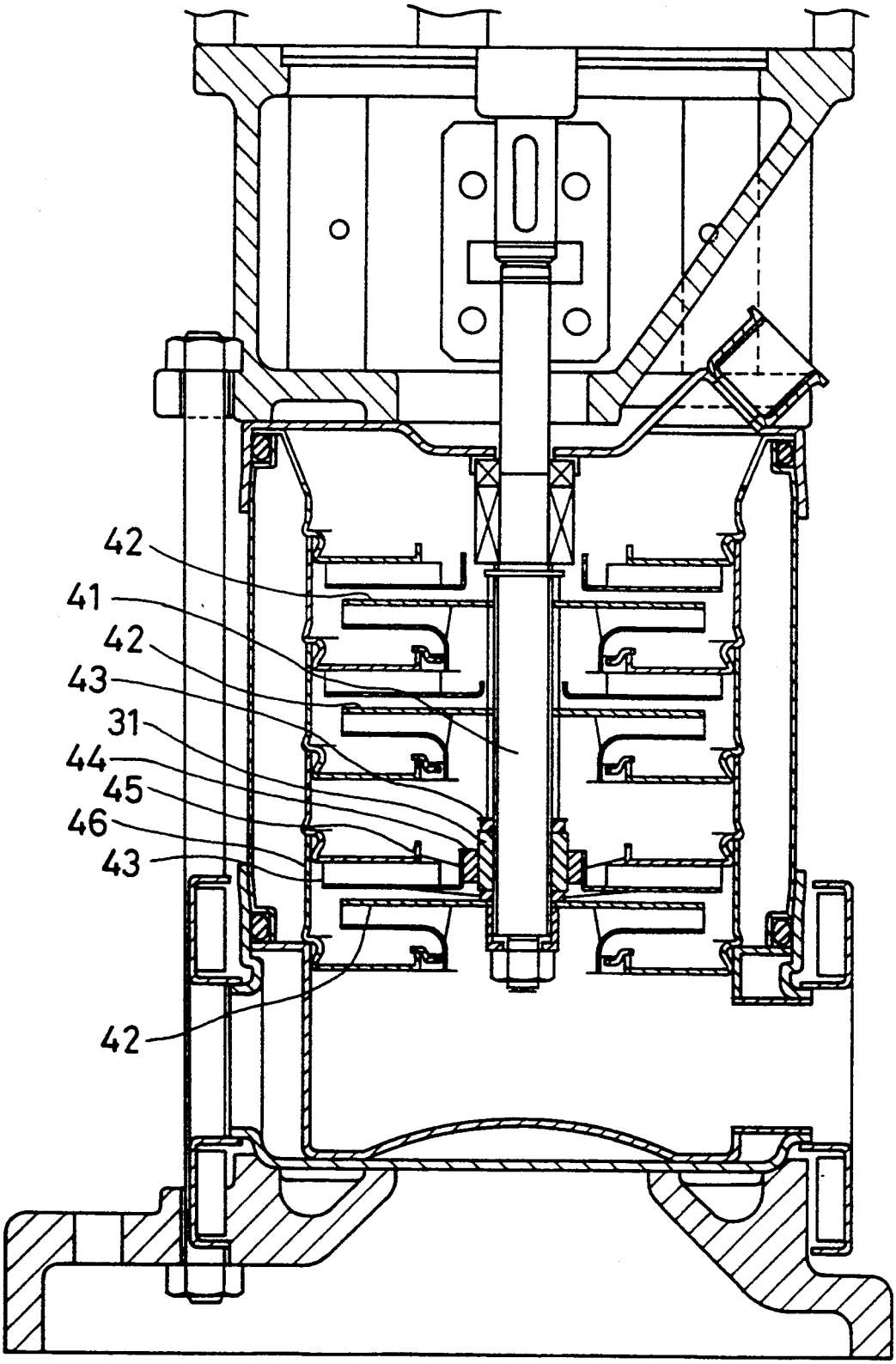
FIG. 4 is a cross-sectional view showing a pump incorporating the shaft sleeve made of ceramics according to the present invention.
Figure 5A:
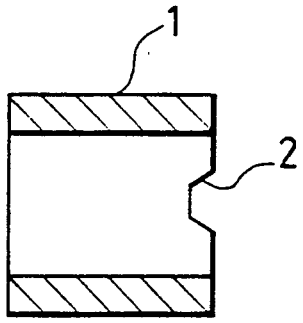
FIGS. 5(*a*) and 5(*b*) show a conventional shaft sleeve, FIG. 5(*a*) being a cross-sectional view showing the conventional shaft sleeve and FIG. 5(*b*) being a side view showing the conventional shaft sleeve.
Figure 5B:
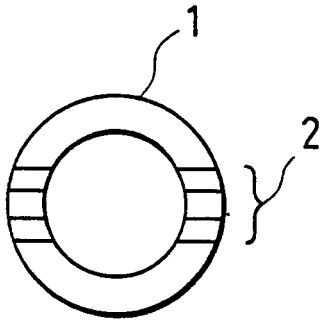
Figure 6A:
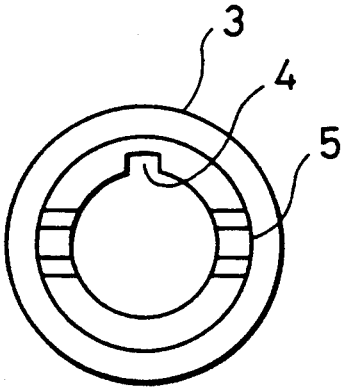
FIGS. 6(*a*) and 6(*b*) show a conventional engaging member, FIG. 6(*a*) being a front view showing the conventional engaging member and FIG. 6(*b*) being a cross-sectional view showing the conventional engaging member.
Figure 6B:
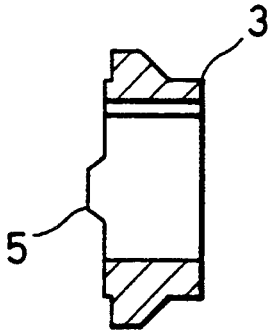
Figure 7A:
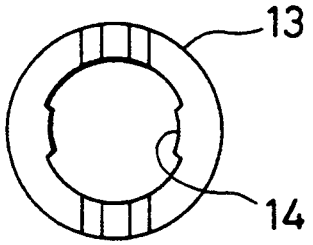
FIGS. 7(*a*), 7(*b*) and 7(*c*) show an engaging member which is used in conjunction with a spline shaft, FIG. 7(*a*) being a front view showing the engaging member, FIG. 7(*b*) being a side view showing the engaging member and FIG. 7(*c*) being an upper plan view showing the engaging member.
Figure 7B:
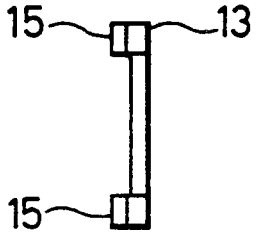
Figure 7C:
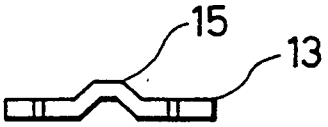
Figure 8:
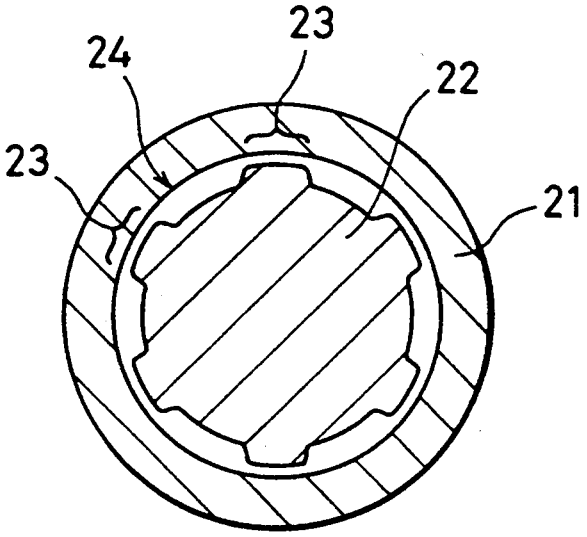
FIG. 8 is a cross-sectional view showing the shaft sleeve applied to the spline shaft.

FIG. 4 shows an example in which the shaft sleeve made of ceramics according to the present invention is incorporated in a multistage centrifugal pump. The multistage centrifugal pump has a main shaft 41 on which a plurality of impellets 42 are provided. The main shaft 41 has one end portion which is provided with the shaft sleeve 31 according to the present invention. Washers 43, 43 are provided on both sides of shaft sleeve 31 so that the axial forces applied to the shaft sleeve 31 are distributed. A bearing 44 is provided radially outwardly of the shaft sleeve 31. The bearing 44 is fixedly secured to a pump casing 46 through a bearing housing 45, thereby rotatably supporting the main shaft 41 and the shaft sleeve 31.

As is apparent from the foregoing description, the shaft sleeve according to the present invention offers the following advantages:

The elastic member molded on the inside surface of the shaft sleeve fills up any dimension tolerance or clearance which is provided to absorb difference in thermal expansion between the shaft sleeve made of ceramics and the shaft made of metal. Therefore, the shaft is tightly fitted with the shaft sleeve. Further, the elastic member serves as a material for absorbing shocks from external forces which impact the bearing. Furthermore, the elastic member serves as a driving force transmitting member, and the driving force is uniformly distributed over the entire surface of the ceramic body, thus reducing the chances of the ceramic body being damaged.

Further, since only the outer sliding surface of the shaft sleeve is subjected to the surface finishing and the inner surface of the sleeve shaft is not finished, the production costs for the shaft sleeve can be reduced.

Particularly, when the shaft sleeve of the present invention is used in conjunction with a spline shaft or a polygonal shaft, the inner surface of the ceramic body need not conform to the cross section of the shaft. Therefore, difficult working of the inner surface of the ceramic body is eliminated, and cracking or damaging of the ceramic body is prevented. Further, an engaging member is not required to prevent the shaft sleeve from rotating relative to the shaft. Furthermore, the shaft sleeve subjected to bending stress due to external forces or vibration is prevented from being damaged or broken.

Although certain preferred embodiments of the present invention have been shown and described in detail, it should be understood that various changes and modifications may be made therein without departing from the scope of the appended claims.

What is claimed is:

1. A shaft sleeve for mounting about a shaft for rotation therewith and for mounting inside an annular bearing for rotation relative thereto, said shaft sleeve comprising:

a ceramic cylindrical body having a cylindrical outer surface and a cylindrical inner surface;

a unitary annular elastic member having a cylindrical outer surface fixedly mounted against said cylindrical inner surface of said ceramic cylindrical body, and an inner surface having a cross-sectional shape corresponding to a cross-sectional shape of an outer periphery of the shaft; and wherein said elastic member constitutes a means for absorbing shock, for transmitting drive from the shaft to said cylindrical body when said shaft sleeve is mounted on the shaft, and for absorbing differences in dimensional variation between said ceramic cylindrical body and the shaft caused by differences in thermal expansion coefficients thereof when said shaft sleeve is mounted on the shaft.

2. A shaft sleeve as recited in claim 1, wherein said elastic member is formed of rubber.

3. A centrifugal pump as recited in claim 1, wherein said elastic member has a thickness in a range of 1 percent to 10 percent of a thickness of said cylindrical body.

4. A shaft sleeve as recited in claim 1, wherein said inner surface of said elastic member has at least one spline-receiving axially extending groove formed therein.

5. A shaft sleeve as recited in claim 1, wherein said inner surface of said elastic member has a polygonally-shaped cross section.

6. A shaft sleeve as recited in claim 1, wherein said inner surface of said elastic member has a cross-sectional shape which defines therewithin an oblong opening.

7. A centrifugal pump comprising:

a pump casing;

a shaft rotatably provided in said pump casing body;

an impeller supported by said shaft;

a shaft sleeve mounted about said shaft for rotation therewith;

wherein said shaft sleeve includes a ceramic cylindrical body having a cylindrical outer surface and a cylindrical inner surface, and a unitary annular elastic member having a cylindrical outer surface fixedly mounted against said cylindrical inner surface of said ceramic cylindrical body, said elastic member further including an inner surface having a cross-sectional shape corresponding to a cross-sectional shape of an outer periphery of said shaft; and wherein said elastic member constitutes a means for absorbing shock, for transmitting drive from said shaft to said cylindrical body when said shaft sleeve is mounted on said shaft, and for absorbing differences in dimensional variation between said ceramic cylindrical body and said shaft caused by differences in thermal expansion coefficients thereof when said shaft sleeve is mounted on said shaft.

8. A centrifugal pump as recited in claim 7, wherein said elastic member is formed of rubber.

9. A centrifugal pump as recited in claim 7, wherein said elastic member has a thickness in a range of 1 percent to 10 percent of a thickness of said cylindrical body.

10. A centrifugal pump as recited in claim 7, wherein said inner surface of said elastic member has at least one spline-receiving axially extending groove formed therein.

11. A centrifugal pump as recited in claim 7, wherein said inner surface of said elastic member has a polygonally-shaped cross section.

12. A centrifugal pump as recited in claim 7, wherein said inner surface of said elastic member has a cross-sectional shape which defines therewithin an oblong opening.

* * * * *

UNITED STATES PATENT AND TRADEMARK OFFICE

CERTIFICATE OF CORRECTION

PATENT NO. : 5,344,678

DATED : September 6, 1994

INVENTOR(S) : Ken-ichi KAJIWARA

It is certified that error appears in the above-indentified patent and that said Letters Patent is hereby corrected as shown below:

On the cover page, in item [75], "Ken-ichi Kajiwara; Kikuichi Mori, both of Tokyo, Japan" should read --Ken-ichi Kajiwara, Tokyo, Japan--;

On the cover page, in item [30], "Dec. 25, 1990 [JP] Japan ..... 2-405851" should read --Dec. 27, 1990 [JP] Japan ..... 2-402363--.

Signed and Sealed this

Twenty-sixth Day of September, 1995

*Attest:*

Bruce Lehman

BRUCE LEHMAN

*Attesting Officer*

*Commissioner of Patents and Trademarks*